US009398656B2

(12) United States Patent
Gray et al.

(10) Patent No.: US 9,398,656 B2
(45) Date of Patent: Jul. 19, 2016

(54) DEVICE AND METHOD FOR DRIVING AN LED LIGHT

(71) Applicants: Richard Landry Gray, Saratoga, CA (US); Yu Hai Mao, Santa Clara, CA (US)

(72) Inventors: Richard Landry Gray, Saratoga, CA (US); Yu Hai Mao, Santa Clara, CA (US)

(73) Assignee: Beijing EffiLED Opto-Electronics Technology Co., Ltd., Songfangyuan, Shangdixili, Haidian District, Beijing (CN)

( * ) Notice: Subject to any disclaimer, the term of this patent is extended or adjusted under 35 U.S.C. 154(b) by 286 days.

(21) Appl. No.: 13/668,771

(22) Filed: Nov. 5, 2012

(65) Prior Publication Data

US 2013/0307424 A1 Nov. 21, 2013

Related U.S. Application Data

(60) Provisional application No. 61/648,005, filed on May 16, 2012.

(51) Int. Cl.
*H05B 33/08* (2006.01)

(52) U.S. Cl.
CPC ..... *H05B 33/083* (2013.01)

(58) Field of Classification Search
CPC ..... H05B 33/083; H05B 33/0803; H05B 33/0815; Y02B 20/342; Y02B 20/347
USPC ..... 315/291, 307, 294, 185 R, 247, 312
See application file for complete search history.

(56) References Cited

U.S. PATENT DOCUMENTS

| | | | | |
|---|---|---|---|---|
| 4,743,897 | A * | 5/1988 | Perez | 345/212 |
| 8,299,724 | B2 * | 10/2012 | Huynh | H05B 33/083 315/291 |
| 9,232,576 | B2 * | 1/2016 | Gray | H05B 33/0803 |
| 2003/0164809 | A1 * | 9/2003 | Leung | 345/46 |
| 2004/0233145 | A1 * | 11/2004 | Chiang | 345/82 |
| 2006/0038803 | A1 * | 2/2006 | Miller et al. | 345/204 |
| 2006/0175985 | A1 * | 8/2006 | Huynh et al. | 315/312 |
| 2006/0244396 | A1 * | 11/2006 | Bucur | 315/312 |
| 2007/0188425 | A1 * | 8/2007 | Saccomanno | 345/82 |
| 2007/0262724 | A1 * | 11/2007 | Mednik et al. | 315/125 |
| 2008/0001547 | A1 * | 1/2008 | Negru | 315/189 |
| 2008/0068192 | A1 * | 3/2008 | Ashdown et al. | 340/664 |
| 2008/0122376 | A1 * | 5/2008 | Lys | 315/192 |
| 2008/0150439 | A1 * | 6/2008 | Bucur | 315/186 |
| 2008/0191642 | A1 * | 8/2008 | Slot et al. | 315/295 |
| 2008/0224025 | A1 * | 9/2008 | Lyons et al. | 250/205 |
| 2008/0315778 | A1 * | 12/2008 | Tatsukawa | 315/193 |
| 2009/0066267 | A1 * | 3/2009 | Kraus et al. | 315/313 |
| 2009/0179575 | A1 * | 7/2009 | Mednik et al. | 315/193 |
| 2009/0218960 | A1 * | 9/2009 | Lyons et al. | 315/297 |
| 2009/0230883 | A1 * | 9/2009 | Haug | 315/297 |
| 2010/0231135 | A1 * | 9/2010 | Hum et al. | 315/250 |
| 2011/0227490 | A1 * | 9/2011 | Huynh | 315/185 R |
| 2016/0088702 | A1 * | 3/2016 | Gray | H05B 33/0812 315/185 R |

* cited by examiner

*Primary Examiner* — Haissa Philogene

(57) ABSTRACT

An approach is provided for devices and methods for driving an LED light, which adjust the numbers of diodes of the LED string corresponding to the rectified AC voltage. The device comprises a power module, a LED string, a current source and a controller. The LED string has multiple LED diodes connected in series that forms a major segment and multiple minor segments. The controller is connected to the current source and the LED string, which selectively shorts the LED diodes of the minor segments. Since the number of LED diodes of the LED string is dynamically adjusted in response to the rectified voltage, the overall "on" voltage of the LED string is more closely matched to the rectified voltage, and thus the power efficiency is improved.

14 Claims, 14 Drawing Sheets

Fig. 1 -- Prior Art--

DEVICE AND METHOD FOR DRIVING AN LED LIGHT

FIELD OF THE INVENTION

Embodiments of the present invention relate to devices and methods for driving a Light Emitting Diode (LED) light, especially toward driving devices and methods using the Current Regulating Device (CRD) scheme utilized to drive LED diodes from a rectified Alternating Current (AC) voltage.

BACKGROUND

The Direct AC driven LED light is probably the most low cost of the traditional LED lamp architectures, due to fewer components, easy configuration and no electromagnetic interference (EMI). However, conventional Direct AC driven LED lighting usually suffers from low efficiency, low frequency flicker and low power factor.

With reference to FIG. 1, FIG. 1 illustrates the conventional current source driven LED light that drives LED diodes directly from a rectified AC voltage. The current source 2 in this circuit architecture of FIG. 1 is also known as the Current Regulating Device (CRD), and such a circuit architecture may suffer a large inefficiency when large voltages appear across the CRD. This situation occurs when the rectified AC voltage is higher than the cumulative voltage of the diodes of the LED string 3. If the rectified AC voltage is lower than the cumulative voltage of the diodes then the circuit will suffer from low frequency flicker. In that situation the LED string 3 turns off once every half cycle leading to a flicker frequency of 100 and 120 Hz for AC input voltages, $V_{AC}$, of 50 and 60 Hz respectively.

Many designs add a large capacitor $C_f$ after the rectifier 1 to change the pulsating waveform from the rectifier to a waveform more closely resembling a DC voltage. The remaining ripple seen after the rectifier 1 is a function of the size of the added capacitor $C_f$ and the magnitude of the load (i.e., LED string 3). As the ripple decreases, the current source 2 that drives the LEDs can become efficient. However, even if the capacitor $C_f$ is made so large as to create an ideal DC voltage after the rectifier, there are still problems with efficiency. Namely, the number of the LED diodes in the string must be designed so that there will always be sufficient voltage across the string to keep them all lit. The variation in LED voltage and input AC voltage $V_{AC}$ require using fewer LED diodes than an ideal number. That means that the rectified voltage will always be higher than the sum voltage of the diodes of the string. Any extra voltage across the current source 2 represents wasted power.

Therefore, there is a need for an approach to provide a device or means so that the "ON" voltage of the LED string is closely matched to the rectified voltage at any given moment.

Some Exemplary Embodiments

These and other needs are addressed by the invention, wherein an approach is provided for devices and methods for driving an LED light that adaptively adjust the numbers of diodes of the LED string so that the voltage required to drive those LEDs is closely matched to the rectified voltage.

According to an embodiment of the present invention, a device for driving an LED light comprises a power module, a LED string, a current source and a controller. The power module is configured for providing a rectified voltage from an Alternating Current (AC) input voltage. The LED string has multiple LED diodes connected in series that forms a major segment and multiple minor segments. The current source is alternatively connected to a first end or a second end of the LED string, which is configured for providing a constant current to the LED string driven by the rectified voltage of the power module. The controller is connected to the current source and the LED string, which selectively shorts the LED diodes of the minor segments so that the voltage required by the LED string is closely matched to the rectified voltage.

According to another embodiment of the present invention, a method for driving an LED light comprises acts of dividing an LED string of the LED light into a major segment and at least one minor segment, and alternatively disabling or enabling the minor segment.

Therefore, the number of LED diodes of the LED string may be dynamically adjusted in response to the rectified voltage, the overall "on" voltage of the LED string is more closely matched to the rectified voltage, and thus the power efficiency is improved.

BRIEF DESCRIPTION OF THE DRAWINGS

The invention is illustrated by way of example, and not by way of limitation, in the figures of the accompanying drawings in which like reference numerals refer to similar elements and in which.

DESCRIPTION OF THE PREFERRED EMBODIMENT

Embodiments of the devices and/or methods are disclosed. In the following description, for purposes of explanation, numerous specific details are set forth in order to provide a thorough understanding of the embodiment of the disclosure. It is apparent, however, to one skilled in the art that the present disclosure may be practiced without these specific details or with an equivalent arrangement.

Figure 1:
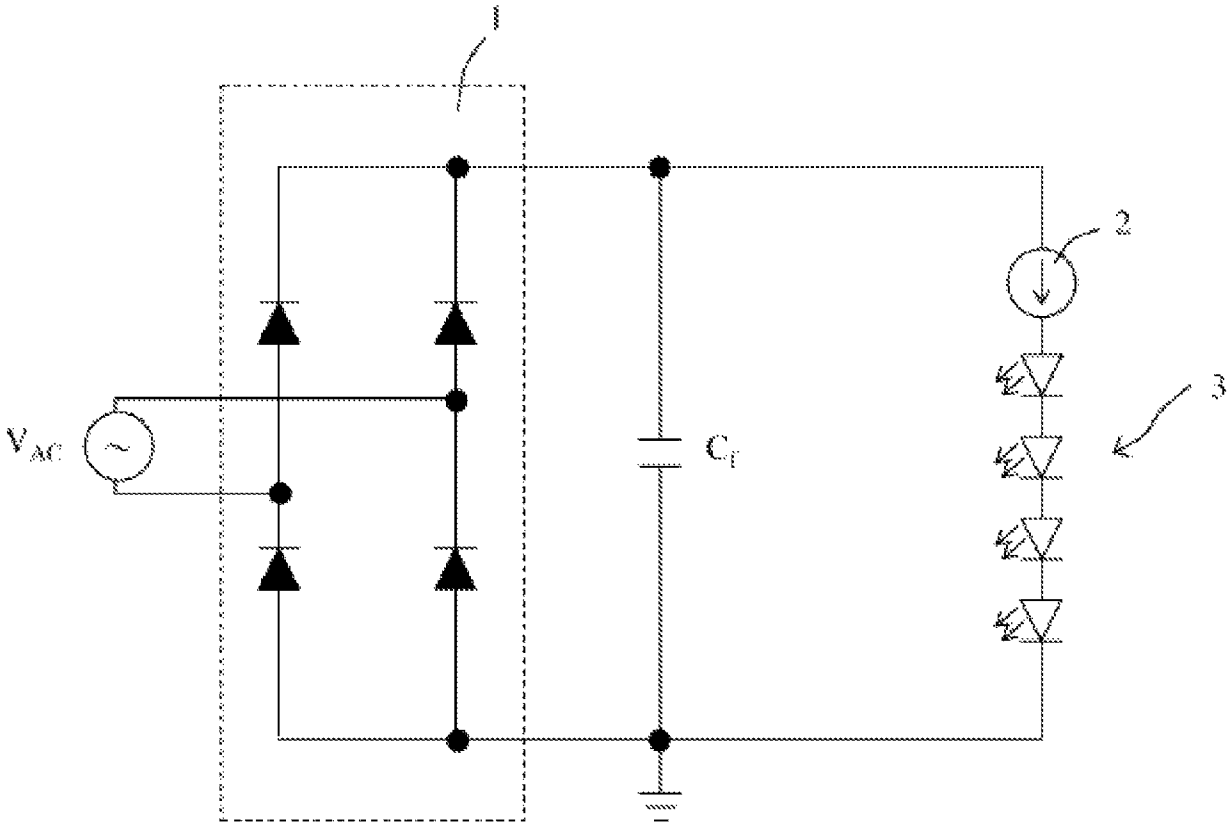
FIG. 1 is an exemplary diagram of a conventional current source driven LED light that drives LED diodes directly from rectified AC voltage.
Figure 2:
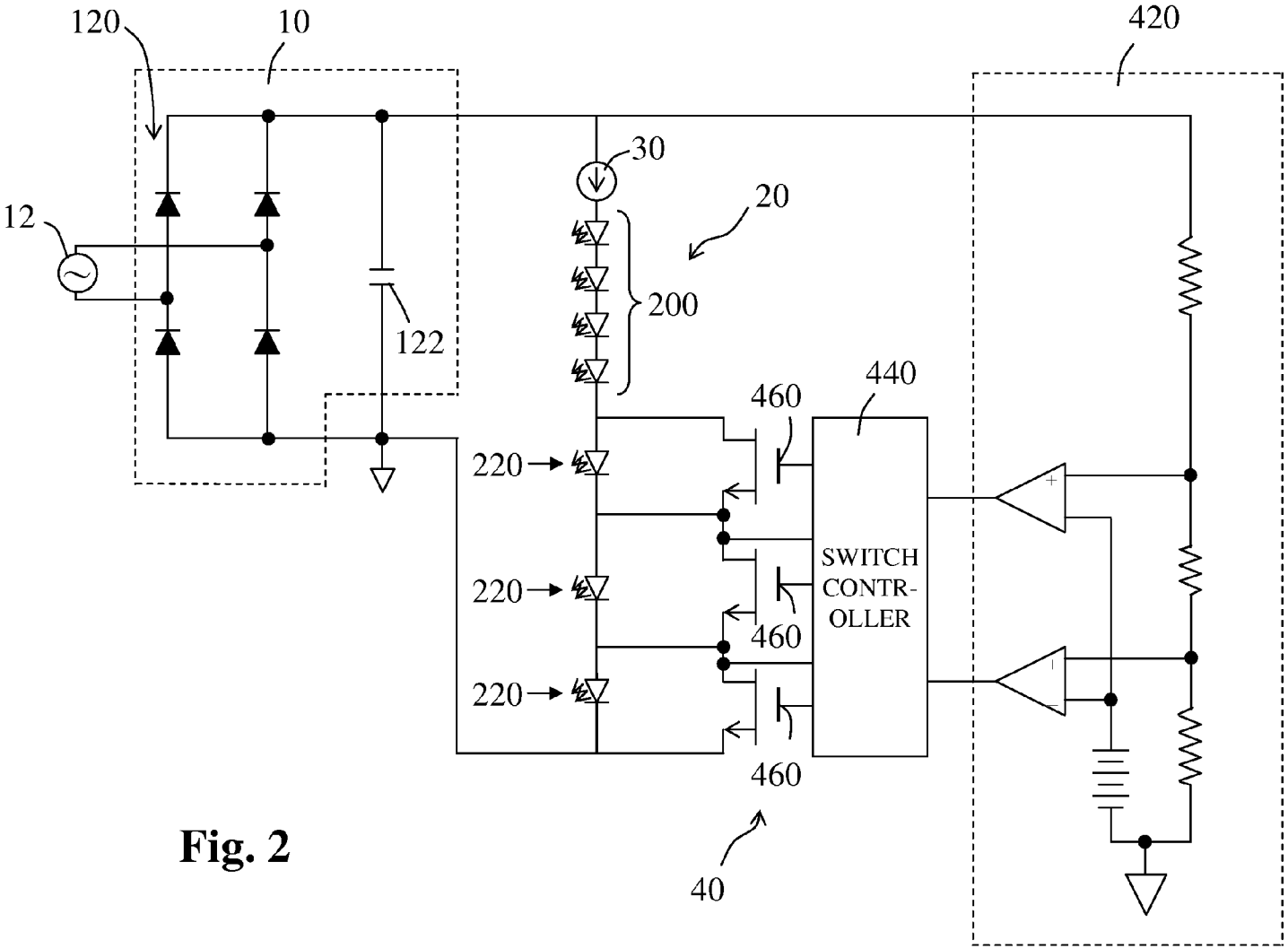
FIG. 2 is an exemplary circuit diagram of a device for driving an LED light in accordance with an embodiment of the present invention.

With reference to FIG. 2, FIG. 2 illustrates a device in accordance with the embodiment of the present invention for driving an LED light. The device comprises a power module 10, a LED string 20, a current source 30 and a controller 40. The power module 10 is configured for providing a rectified voltage from an Alternating Current (AC) input voltage. The power module 10 is connected to an AC voltage source 12, and comprises a diode rectifier 120 and a filter capacitor 122. The diode rectifier 120 converts the AC input voltage to a pulsating DC voltage, and the filter capacitor 122 smoothes the pulsating DC voltage to a rectified voltage that more closely resembles a DC voltage.

The LED string 20 has multiple LED diodes connected in series that forms a major segment 200 and multiple minor segments 220. In this example, as shown in FIG. 2, the LED string 20 consists of one major segment 200 and three minor segments 220. The major segment 20 consists of four LED diodes (four LED diodes was chosen for ease of illustration, in most offline applications the number of diodes in string 200 would be much greater) and each minor segment 220 consists of one LED diode. The current source 30 is connected to the first end the LED string 20 and the power module 10, which is configured for providing a constant current to the LED string driven by the rectified voltage of the power module 10.

The controller 40, as shown in FIG. 2, is connected to the power module 10, the current source 30 and the LED string 20, which selectively shorts the LED diodes of the minor segments 220 so that the cumulative on voltage of all the LED diodes in string 20 is closely matched to the rectified voltage. In this embodiment, the controller 40 comprises a voltage sensing module 420, a switch controller 440 and at least one switch 460. The voltage sensing module 420 is connected between the current source 30 and the switch controller 440, and senses the voltage across the output of the power module 10. The switch 460 is connected between the minor segment 220 and the switch controller 440, and may be a transistor that has a gate, source and a drain. The gate is connected to the switch controller 440. The source is connected to a second end of the minor segment 220. The drain is connected to a first end of the minor segment 220, the switch controller 440, and the source of the preceding switch 460. The number switches 460 is based on the number of the minor segments 220. In this embodiment, the number of the minor segments 220 is three and the number of switches 460 is three as well.

The switch controller 440, which includes logic and level shifters for turning the switch 460 ON and OFF according to the sensed rectified voltage, adds or subtracts LED diodes of the minor segment 220 from the LED string 20. In this manner, the cumulative "on" voltage of the LED string is closely matched to the rectified voltage. For instance, the minor segment 220 is added to the LED string 20 as the rectified voltage increases, and is removed as the rectified voltage decreases. In order to avoid flicker, the switch controller 440 is preset to short out a predetermined number of the minor segments 220, so that the cumulative voltage of the LED string 20 is always lower than the rectified voltage (otherwise current would cease flowing in the LED string). Since the voltage sensing module 420 is able to detect the value of the rectified voltage, the switch controller 440 uses the output of the voltage sensing module 420 to determine a correct number of the minor segment 220 to be shorted using a predetermined relation.

A person skilled in art will realize that the relative positions of the current source and the controller 40 may be swapped without any decrease in functionality.

Figure 3B:
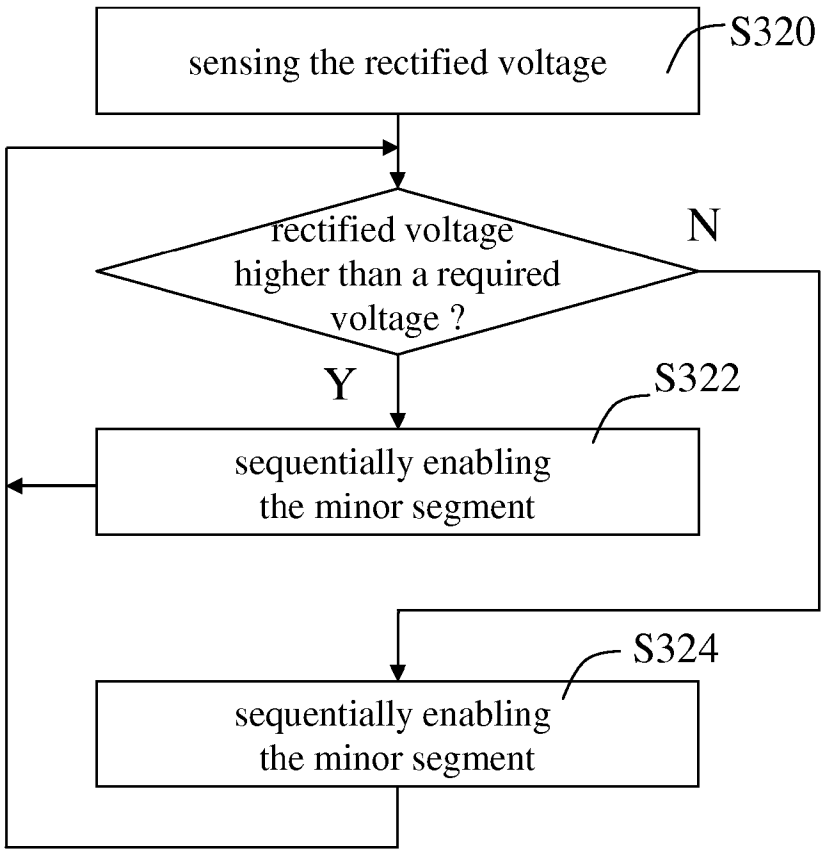
FIG. 3B is a flowchart of step S32 in FIG. 3A in accordance with an embodiment of the present invention.
Figure 3A:
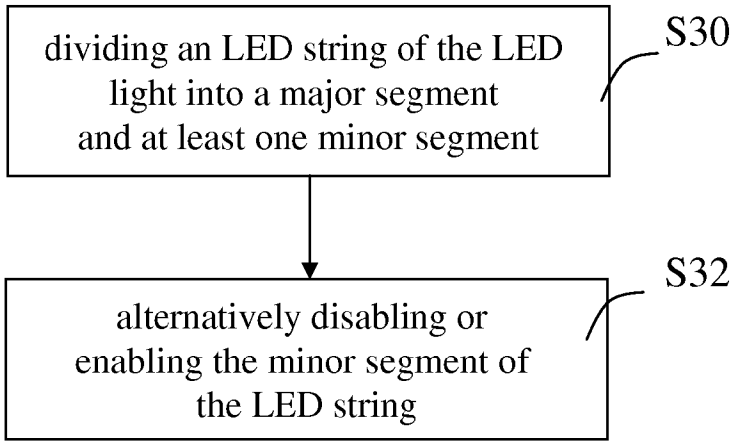
FIG. 3A is a flowchart of a method for driving an LED light in accordance with an embodiment of the present invention.

With reference to FIGS. 2, 3A and 3B, a method in accordance with the embodiment of the present invention for driving an LED light may, but is not limited to, apply to the above mentioned device embodiment of FIG. 2. The method comprises acts of S30 dividing an LED string of the LED light into a major segment and at least one minor segment, and S32 alternatively disabling or enabling the minor segments of the LED string.

As shown in FIG. 3B, the act of S32 alternatively disabling or enabling the minor segment further comprises acts of S320 sensing the rectified voltage, S322 sequentially enabling the minor segment (i.e. adding more diodes to the LED string) when the rectified voltage is higher than a required voltage, and S324 sequentially disabling the minor segment when the rectified voltage is not higher than the required voltage.

A large benefit of this type design shown in FIG. 2, is that the voltage breakdown requirement for both current source 30 and the controller 40 is quite modest. There is no need for either the current source 30 or the controller 40 to withstand the entire rectified voltage. The controller 40 actually lessens the voltage breakdown demands on the current source 30. This is due to the fact that as the rectified voltage increases more and more minor segments 220 are added to the LED string 20 which limits the voltage which current source 30 must withstand. One drawback, although not fatal, to the embodiment shown in FIG. 2 is that it does not account for variations in diode voltage due to the processing variations and temperature drift of the LED diodes, since the switch controller only responds to the rectified input voltage.

Figure 4A:
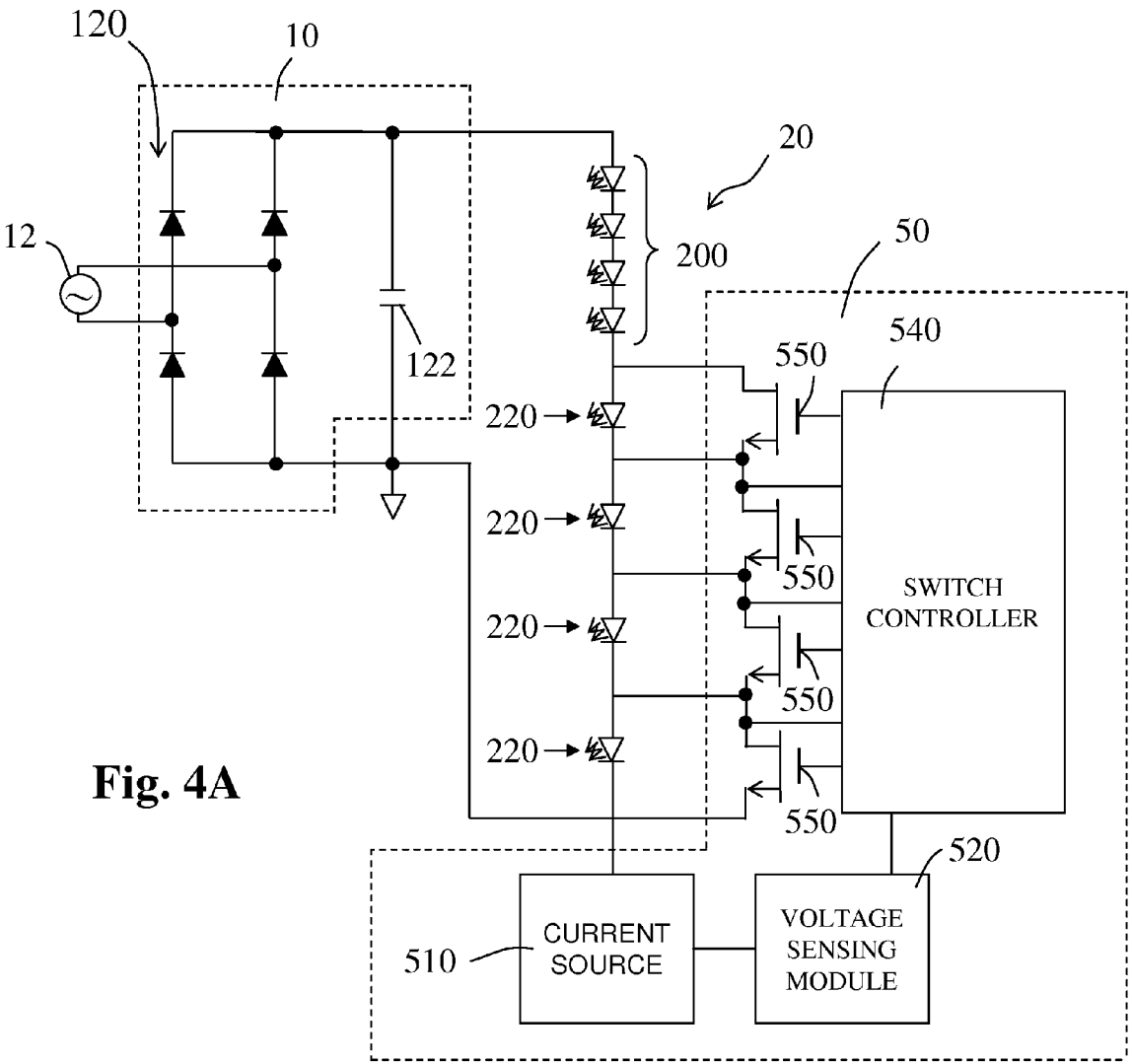
FIG. 4A is an exemplary circuit diagram of a device for driving an LED light in accordance with another embodiment of the present invention.

With reference to FIG. 4A, another embodiment of a device for driving an LED light is provided, which is similar to the embodiment shown in FIG. 2. However, in this embodiment, the voltage sensing module no longer measures the rectified voltage, but instead measures the voltage across the current source. In such manner the voltage across the current source is kept with in a certain range as the minor segment LED diodes are added or subtracted to the LED string. The power dissipation of the current source is limited resulting in higher efficiency by maintaining a lower voltage across the current source at all times.

In addition, in this embodiment, the variations of the LED voltage and the input AC voltage no longer matter. The switch controller keeps adding and subtracting minor segments to the LED string in order to maintain the current source voltage in a desired region. In the actual implementation of the invention the desired region of current source voltage is only several volts, which results in very small wasted energy across the current source and consequently efficiencies that are easily over 97%.

Figure 4B:
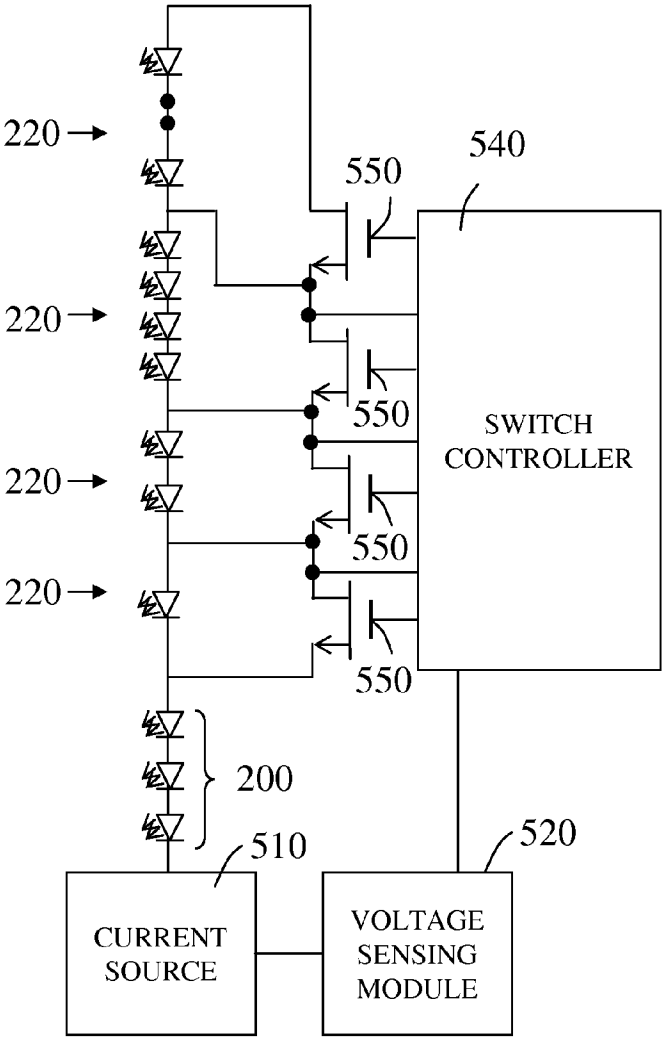
FIG. 4B is a partial exemplary circuit diagram of a device for driving an LED light in accordance with another embodiment of the present invention.
Figure 5:
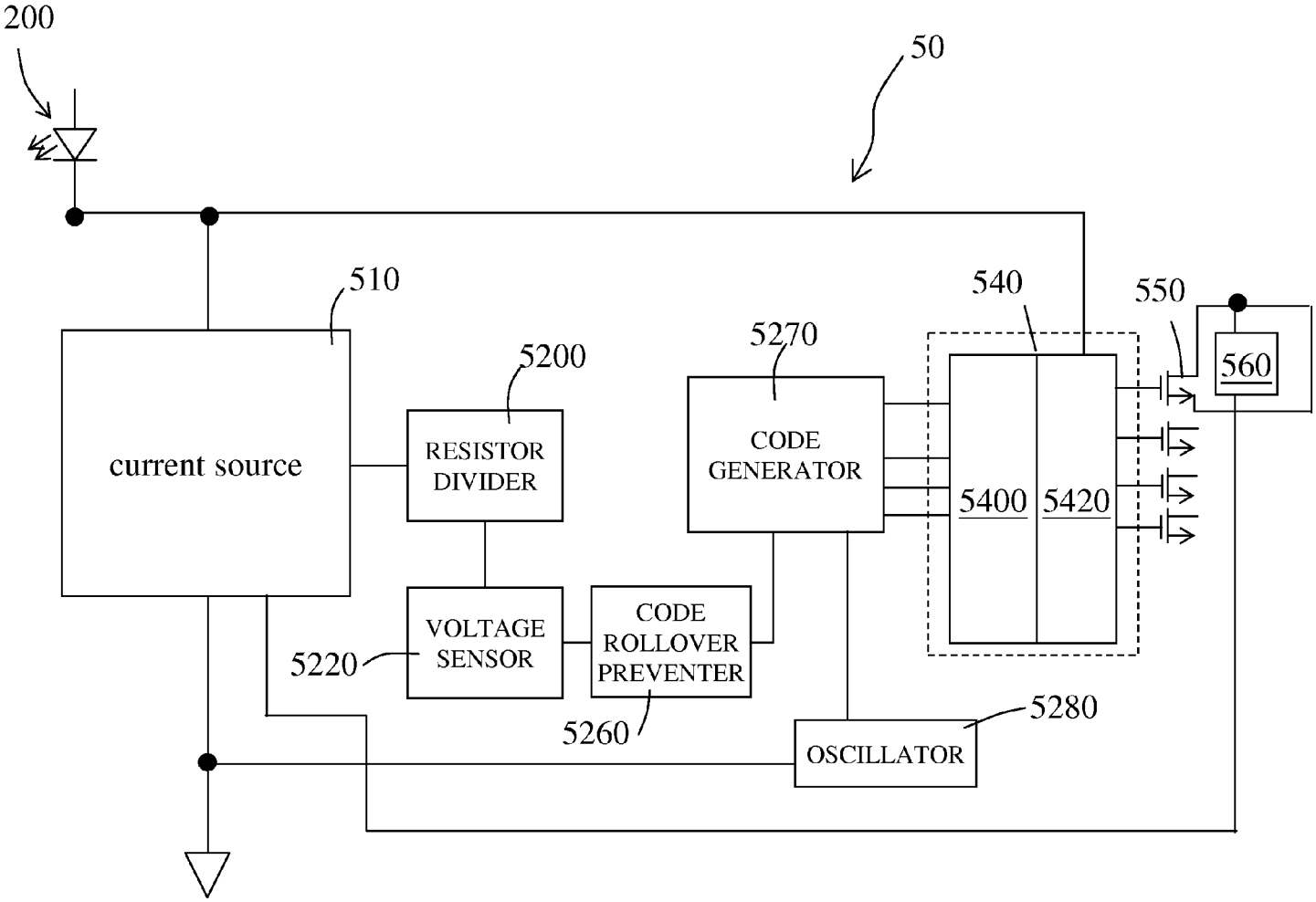
FIG. 5 is an exemplary circuit diagram of the compact controller 50 in FIG. 4 in accordance with an embodiment of the present invention.

With reference to FIGS. 4A, 4B and 5, the device for driving an LED light is illustrated in a compact IC block (Shown in FIG. 4A) that integrates the current source, the controller, and the switches together. In this embodiment, the device comprises the power module 10, a LED string 20 and a compact controller 50. The LED string 20 consists of one major segment 200 and four minor segments 220. The compact controller 50 comprises a current source 510, a voltage sensing module 520, at least one switch 550 and a switch controller 540.

In this embodiment, the current source 510 is connected to the second end of the minor segment 220 of the LED string 20. The voltage sensing module 520 comprises a resistor divider 5200, a voltage sensor 5220, a code generator 5270 and an oscillator 5280. The resistor divider 5200 is connected to the current source 510, and is configured to detect the voltage across the current source 510 (FIG. 5). The voltage sensor 5220 is connected to the resistor divider 5200, and determines a voltage state based on the detected voltage from the resistor divider 5200. The voltage sensor 5220 may be implemented using at least one window comparator circuit that employs a dual operational amplifier comparing the detected voltage with reference voltages, and outputting signals for indicating the voltage state of the current source.

However, since the circuit arrangements (i.e., the current source 510 and the window comparator circuit of the voltage sensor 5200) are known to one skilled in the art, redundant description is omitted, the skilled person may still practice the invention without these specific details or with an equivalent arrangement in light of the present disclosure.

The code generator 5270 is connected to the voltage sensor 5220 (through a code rollover preventer, 5260, described later) and generates a level signal indicating the voltage state from the voltage sensor 5220. The oscillator 5280 is connected to the code generator 5270, and generates a clock signal. The code generator 5270 changes state on transitions of the clock signal in order that the code generator 5270 responds to valid signals from the voltage sensor 5220 and not spurious signals generated by the system's finite transient response to changes between different codes. The frequency of the clock signal is not particularly important, however it must be significantly faster than the fastest variation of line voltage that the system may encounter. Frequencies that are too fast will not allow the voltage sensor to settle to a valid state and the code generator 5270 may choose its state based on faulty information provided by the voltage sensor 5220.

The code generator 5270, in this embodiment, may be a 4 bit U/D (up/down) counter whose output is a 4-bit binary word. Each different binary word indicates which of the minor segments 220 will be shorted and which segments will not be shorted. For example, if the 4 bit output is "1100", it means the first two minor segments 220 are added to the LED string 20 and the second two minor segments 220 are shorted out.

The switch controller 540 is connected to the voltage sensing module 520, and is configured to short the LED diode of the minor segment 220 through the switch 550 based on the outputs of code generator 5270. The switch 550 may be a transistor and the number of the switches 550 corresponds to the number of the minor segments 220. The drain and source of the switch 550 are connected to the minor segment 220 respectively.

However, as shown in FIG. 4B, FIG. 4B shows another embodiment of 4A where the numbers of diodes in the minor segments 220 are different and the major segment 200 is placed on the same side as the current source 510. As shown in FIG. 4B, the number of diodes to the minor segments 220 are arranged in a binary format having a relationship of: $U_D=2^n$, n=0, 1, 2, 3 . . . N, wherein $U_D$ is the number of the diodes in the corresponding minor segment, and N is the number of switch 550.

Accordingly, the first switch shorts out $2^0$ diodes, the second switch shorts out $2^1$ . . . and the tenth switch shorts out $2^{10}$ diodes. Using the previous mentioned 4 bit U/D counter as an example, when it generates a "1100", the meaning is that the second two minor segments 220 with twelve (i.e. $2^2+2^3$) diodes are shorted out.

In addition, in order to avoid the code generator 5270 from rolling over, the compact controller 50 further comprises a code rollover preventer 5260 connected to the code generator 5270. The code rollover preventer 5260 may be some decoding logic that prevents the code generator outputs from making a "1111" to "0000" when 5270 is counting up or a "0000" to "1111" transition when counting down. If those transitions were allowed to occur then the proper feedback relation between sensed current source voltage and the proper sequence of enabled and disabled switches 550 would be broken.

The switch controller 540, in this embodiment, may be implemented using a hysteretic level shifter that has a low side input 5400 and a high side output 5420. The low side input 5400 of the level shifter 540 is connected to the code generator 5270 for receiving the output of the code generator. The high side 5420 of the level shifter 540 generates a control signal selectively turning the switches 550 ON and OFF. As shown in FIG. 5, the high side 5420 of the level shifter 540 is connected to the gates of the switches 550. In other words, the switch controller 540 converts the output of the code generator to a control signal, and the control signal shorts the minor segments 220 by selectively turning on the switches 550 based on the received output from code generator 5270.

Unless further action is taken, each time an extra LED diode of the minor segment 220 is added to the main LED string 20, the brightness of the LED light will increase slightly. In order to offset this brightness change, the compact controller 50 further comprises an offset unit 560. The offset unit 560 is connected between one end end of the minor segment 220 and a controlling node in current source 510. As successive minor segments 220 are added to the LED string 20, the voltage on the bottom end of the major segment 200 (using FIG. 4 in this case) will increase, which will also increase the current through the offset unit 560 and subsequently into the current source 30. The offset unit 560 is configured for modulating the current through the current source 30 and maintaining a constant illumination output of the LED string 20.

In an embodiment, the offset unit 560 may be an analog feedback unit such as resistors that senses numbers of the minor segments that have been added to the LED string 20. However, the offset unit can also be a digital unit where the feedback is not analog in nature but is a digital word.

Figure 6:
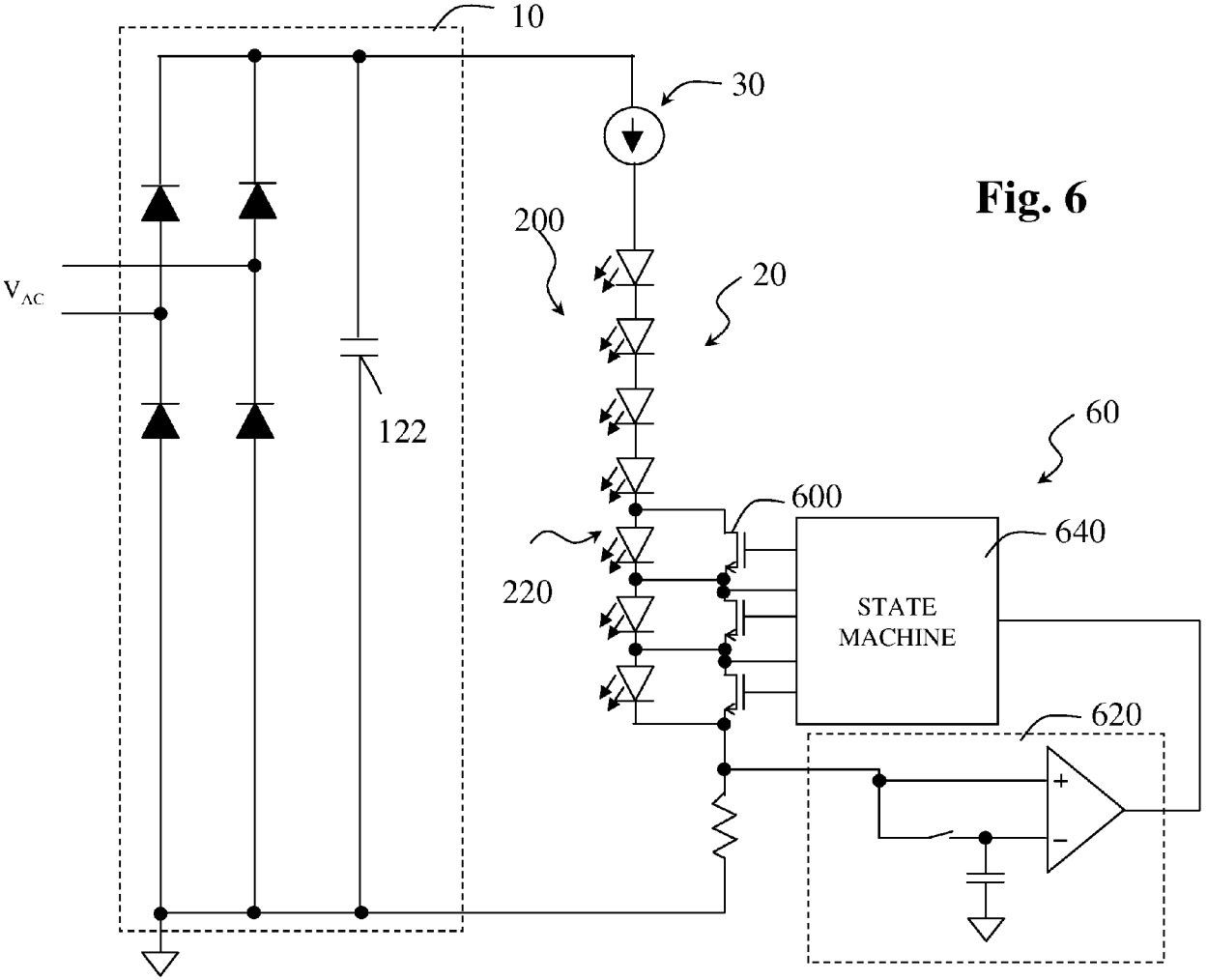
FIG. 6 is an exemplary circuit diagram of a device for driving an LED light in accordance with yet another embodiment of the present invention.

With reference to FIG. 6, FIG. 6 illustrates another embodiment of the present invention for a device for driving an LED light. In this embodiment, the device does not sense the voltage of the current source or the rectified voltage but instead looks for a decrease in current of the LED string as extra minor segments 220 are added into the major segment 20. The decrease of the LED string current indicates that the composite LED string, consisting of non-shorted minor string 220 in series with major string diodes 20, does not have enough voltage across it in order to supply a steady current. In contrast to the circuit of FIG. 4, the embodiment of FIG. 6 selects the optimal number of enabled/disabled minor string LEDs 220 by monitoring the current through the LED 20 string so that the LED string voltage is always just barely enough to maintain the desired current in the LED string 20. The device comprises the power module 10, the LED string 20 and the controller 60. The controller 60 sequentially shorts the minor segment 220 from the LED string 20 for every time a current though the LED string 20 has decreased.

In this embodiment, as shown in FIG. 6, the controller 60 may be implemented using at least one switch 600, a current decrease detector 620 and a state machine 640. The current decrease detector 620 is connected to the second end (i.e. bottom) of the LED strings and generates a triggering signal when a present current value is lower than the previous current value or lower than some preset value. The state machine 60 sequentially shorts out the minor segments 220 from top to bottom through the switches 600 as triggered by the triggering signal of the current decrease detector 620.

Figure 7:
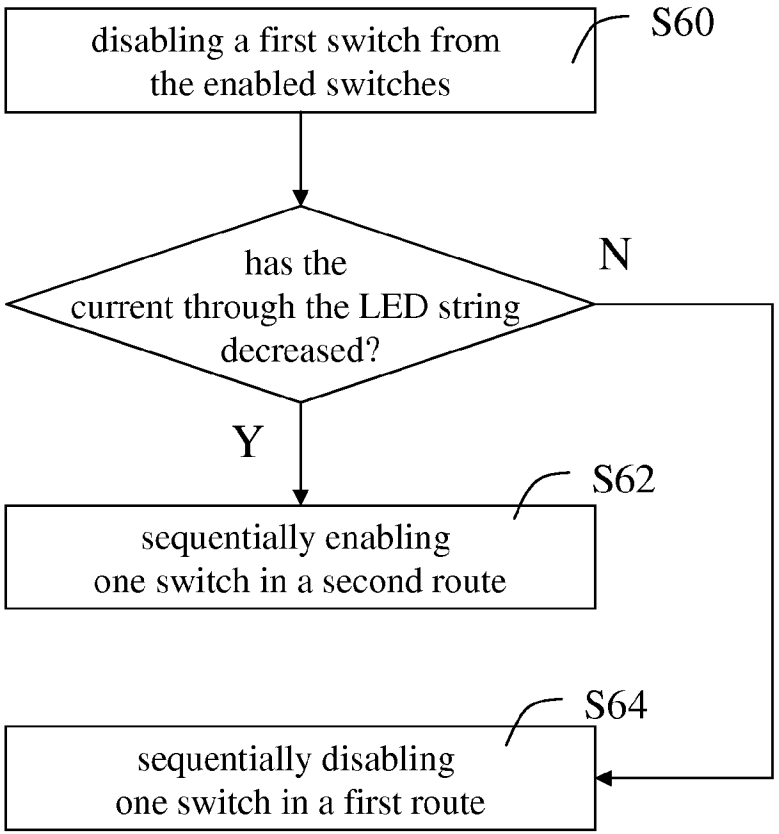
FIG. 7 is a flowchart of a method for driving an LED light in accordance with another embodiment of the present invention.

With reference to FIGS. 6 and 7, an embodiment of a method for driving an LED light of the controller 60 that alternatively disables or enables the minor segment of the LED string. The method, in this embodiment, comprises acts of S60 disabling a first switch 600A from the enabled (i.e. closed) switches 600, S62 sequentially disabling (i.e. opening) one switch 600 in a first route when current through the LED string has not decreased, and S64 sequentially enabling one switch 600 in a second route when current through the LED string has decreased. The minor segments 220, as shown in FIG. 6, are connected in series at bottom of the major segment 200 of the LED string 20, thus the first route, in an embodiment, is defined from top to bottom and the second route is defined as the reverse of the first way.

Accordingly, as all the switches 600 are enabled that means all the minor segments 220 are electrically removed from the LED string 20. That means that all current through the LED string 20 goes through the major segment 200 and is shunted around the minor switches 220 by switches 600. When the first switch 600A is disabled, current through the LED string 20 flows through major segment 200 and one minor segment 220. When more and more minor segments 220 are added to the LED string 20, the LED current may decrease as the current source does not have enough voltage across it to supply a steady current. In such a situation the controller removes the added minor segments 220 in a reverse order until the current though the LED string no longer decreases. Once the controller 60 has determined the optimal combination of on and off switches, which ensures the LED string 20 is always operating in its most efficient condition, it will wait a certain period of time and then check again. For example, the period for recheck may be 10 seconds to some number of minutes or even longer for certain applications.

Figure 8:
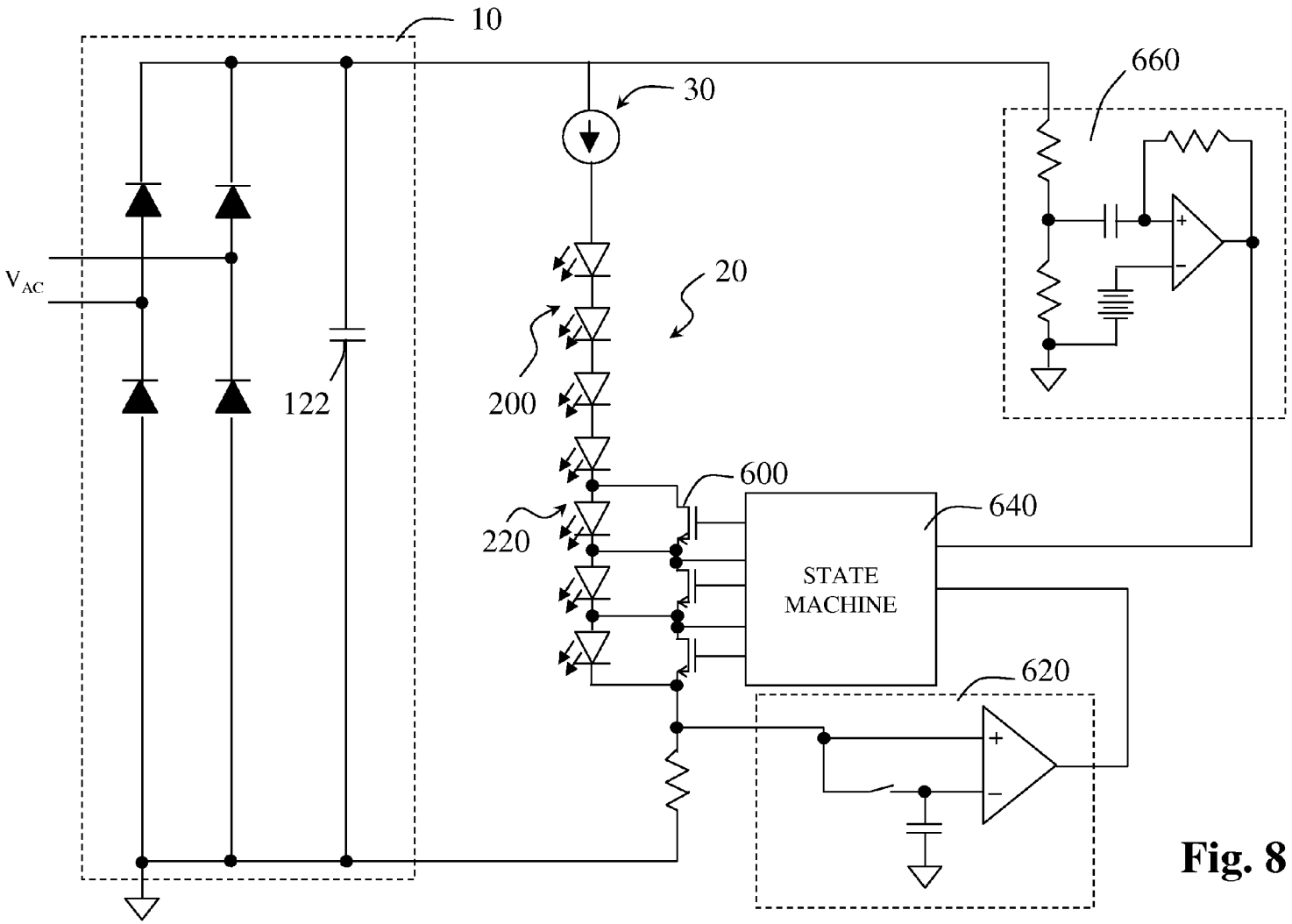
FIG. 8 is an exemplary circuit diagram of a device for driving an LED light in accordance with yet another embodiment of the present invention.

With reference to FIGS. 6 and 8, FIG. 8 illustrates another embodiment of a device for driving an LED light, which is similar to the device of FIG. 6. Due to the ripple of the rectified AC voltage, the controller 60 of FIG. 6 may erroneously determine that there was enough voltage to sustain the desired current through the LED string 20 for the whole period of the input voltage AC waveform if the LED current happened to be examined at a time when the ripple voltage was near its peak value. Accordingly, the embodiment of FIG. 8 solves such a problem, which further comprises a ripple voltage detector 660 connected between the power module 10 and the state machine 640. The ripple voltage detector 660 is able to detect the minimum value of the ripple voltage so that the LED current can be examined at that time. If the LED string has enough voltage across it to sustain the desired current when the voltage ripple is at its minimum value, then it will certainly have sufficient voltage to sustain the desired current at all other regions of the ripple period. Once the point of the minimum value of the ripple voltage has been identified, the possibilities of erroneous LED current sampling can be avoided.

Figure 9A:
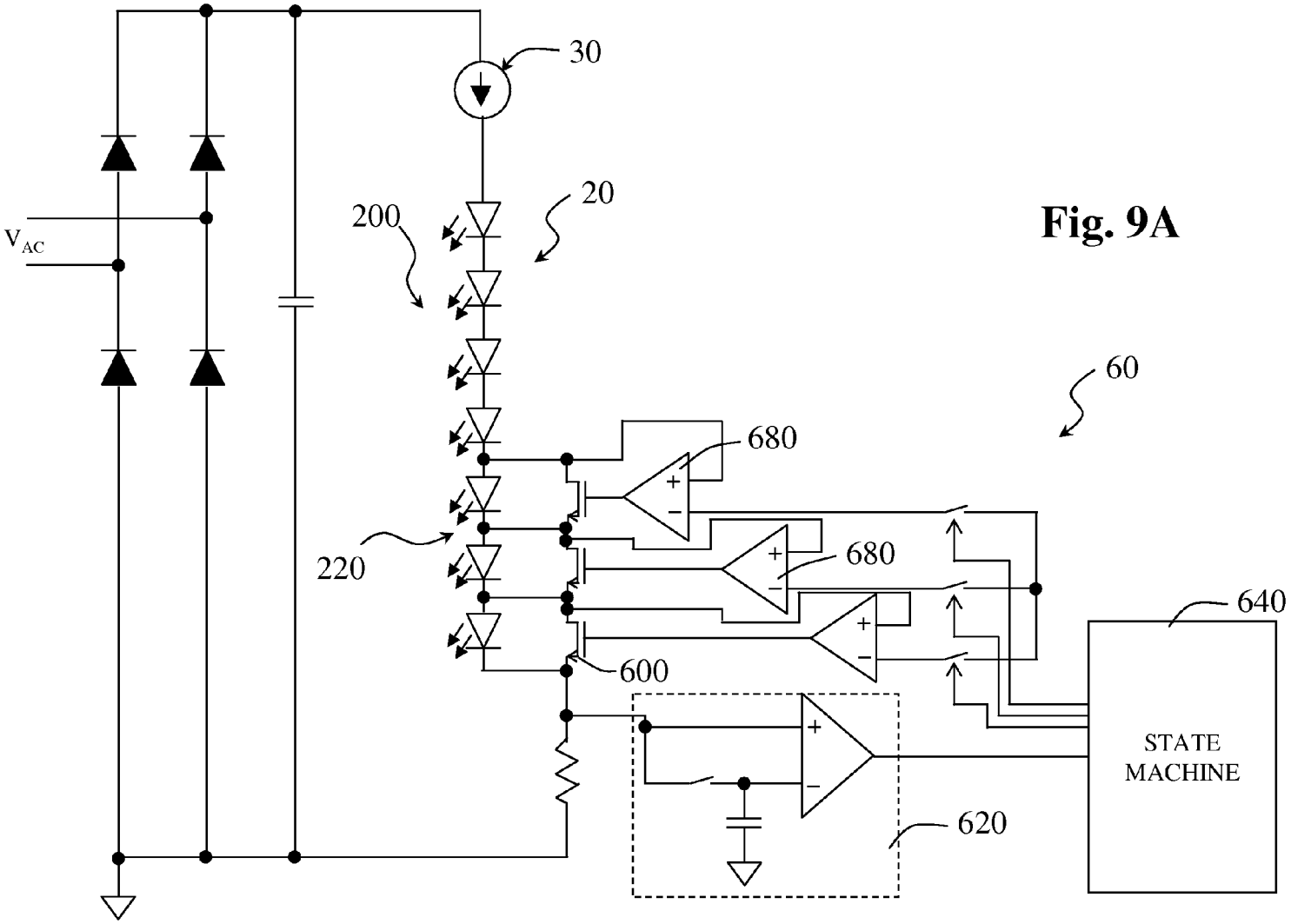
FIG. 9A is an exemplary circuit diagram of a device for driving an LED light in accordance with yet another embodiment of the present invention.
Figure 9B:
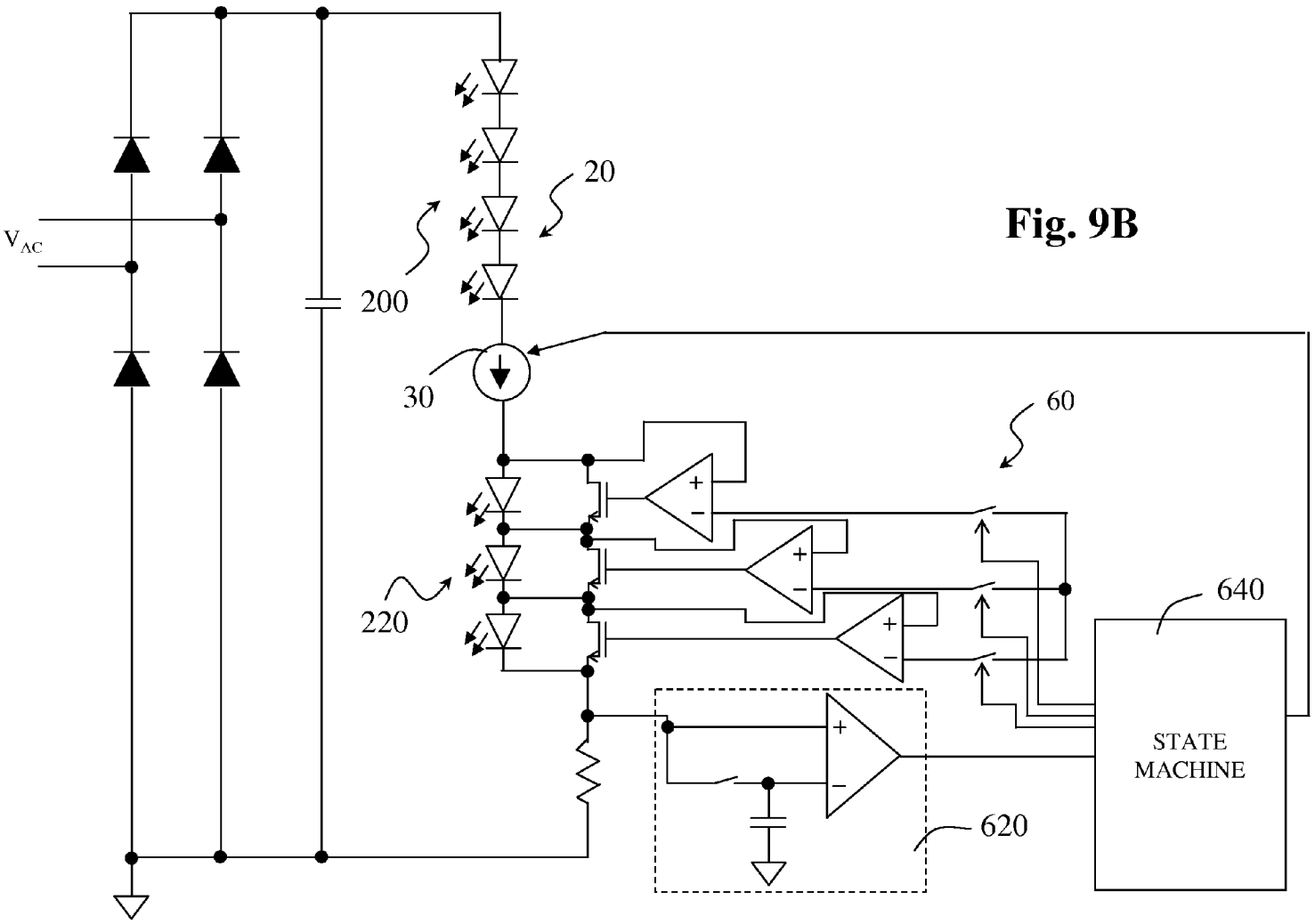
FIG. 9B is an exemplary circuit diagram of a device for driving an LED light in accordance with yet another embodiment of the present invention.

FIGS. 9A and 9B illustrate two embodiments which do not require a specific voltage detector to find the minimum of ripple voltage. In these embodiments, the controller 60 further comprises at least one error amplifiers 680 modulating the switches 600 in a servo loop so that the voltages across the switches 600 change slowly. Instead of measuring the resulting LED current as the minor segments 200 added to the LED string 20 once per each input voltage period, the current in the LED string due to the added minor segments 200 slowly changes over a period of many voltage cycles. If a decrease of LED current is detected at any time while one of the switches 60 is being opened then the state machine will immediately cause that switch to close.

The difference between the embodiments of FIGS. 9A and 9B, is that the current source 30 of FIG. 9A is placed on the opposite side of the major segment 200 of the LED string 20 from the state machine 640. The current source 30 of FIG. 9B is moved to the same side of the major segment 200 of the LED string, which allows the controller 60 to easily communicate with the current source 30 since their voltages are close to the same. For the circuit of FIG. 9A there is a potential to have a large voltage between current source 30 and controller 60 making communication between those two blocks more difficult.

Accordingly, as the rectified voltage decreases towards the minimum value of the ripple voltage, a decrease in current of the LED string will be immediately detected and corrected, and thus the LED current during the minimum value of the ripple voltage is automatically tested.

A Current Regulating Device (CRD) scheme for driving an LED light normally needs a large filter capacitor after the diode bridge to maintain constant LED illumination by storing enough energy to supply the load with current when the rectified voltage waveform would otherwise be lower than the minimum required for current to flow through the LED string. These large filter capacitors will typically limit power factor (PF) of the appliance to approximately to 0.5. Therefore, as shown in FIG. 10, a current limiting device (CLD) 70 is added for increasing the value of PF.

Figure 10:
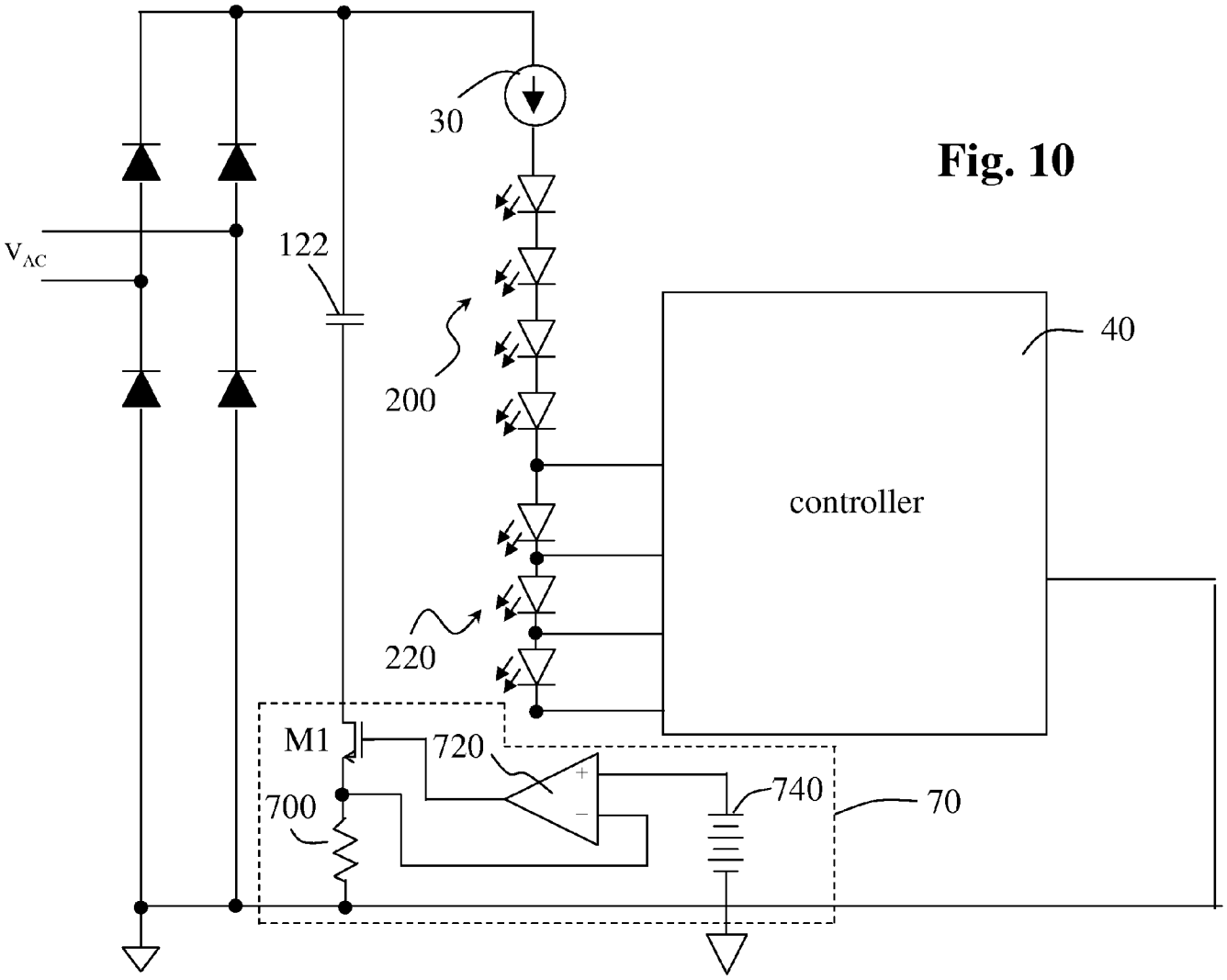
FIG. 10 is an exemplary circuit diagram of a device for driving an LED light with a current limiting device in accordance with yet another embodiment of the present invention.

In this embodiment, as shown in FIG. 10, the CLD 70 comprises a high-voltage transistor M1, a current sensing resistor 700, an amplifier 720, and a reference voltage 740. A drain of the high-voltage transistor M1 is connected to the negative side of filter capacitor 122. The current sensing resistor 700 is connected between the source of the high-voltage transistor M1 and the ground (GND). The amplifier 720 has a first input, a second input and an output. The first input is connected to the reference voltage 740, the second input is connected to the source of the high-voltage transistor M1 and the current sensing resistor 700, and the output is connected to the gate of the high-voltage transistor M1. The value of the sensing resistor 700 is configured for setting the current limit to a desired value.

The CLD 70 limits the charging current of the filter capacitor 122 of the power module 10, thus the charging time is spread out over a longer time interval and the peak value of the charging current decreases, all of which cause the power factor (PF) to increase.

Figure 11:
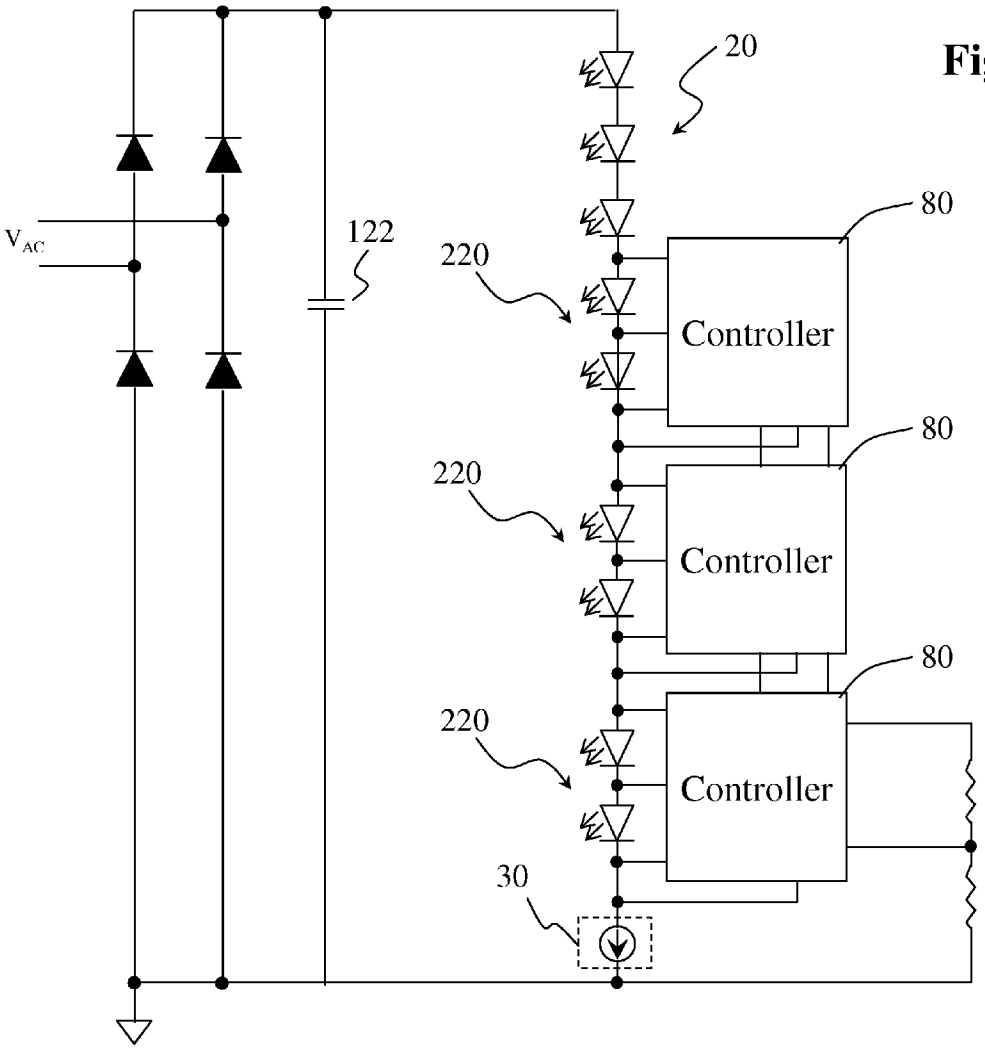
FIG. 11 is an exemplary circuit diagram of a device for driving an LED light in accordance with yet another embodiment of the present invention.

FIG. 11 illustrates another embodiment of a device for driving an LED light. In order that the invention may correct for higher ripple voltage and wider line voltage variation the controller described in the previous paragraphs may require a higher breakdown voltage. Instead of building the controller from a higher voltage process, which may unacceptably increase manufacturing costs, we can use multiple low voltage process controllers as shown in FIG. 11 to achieve the same result at lower cost. The embodiment shown in FIG. 11, discloses a stack-able controller scheme which is adapted for acquiring a higher overall voltage capability. The controllers 80 are connected in series and each controller 80 is connected to the corresponding minor segment 220. The current source at the bottom of the string of series connections of controllers 80 must communicate status about the current source voltage (or current) up through the stack of controllers 80 so that the proper minor segments 220 may be added or subtracted from the composite LED string.

The filter capacitor 122 described in previous embodiments must be large (e.g. tens of uF) enough to store enough energy for a particular application. It must also withstand the high rectified voltage. The usual candidate for this type of capacitor is an electrolytic capacitor. However, electrolytic capacitors are physically large and can have short lifetimes when operating under a high temperature environment. Some lighting customers require that no electrolytic capacitor be used in a lamp design for improving PF and improving lamp lifetime, but techniques to remove the electrolytic capacitors often introduce flicker issues due to the limited energy storage capability of smaller non-electrolytic type capacitors. Typically this flicker will occur at twice the input line voltage frequency i.e. 100 Hz flicker for 50 Hz input line voltage frequency. Most research now indicates that flicker frequency must be higher than 200 Hz to avoid deleterious health effects.

Figure 12:
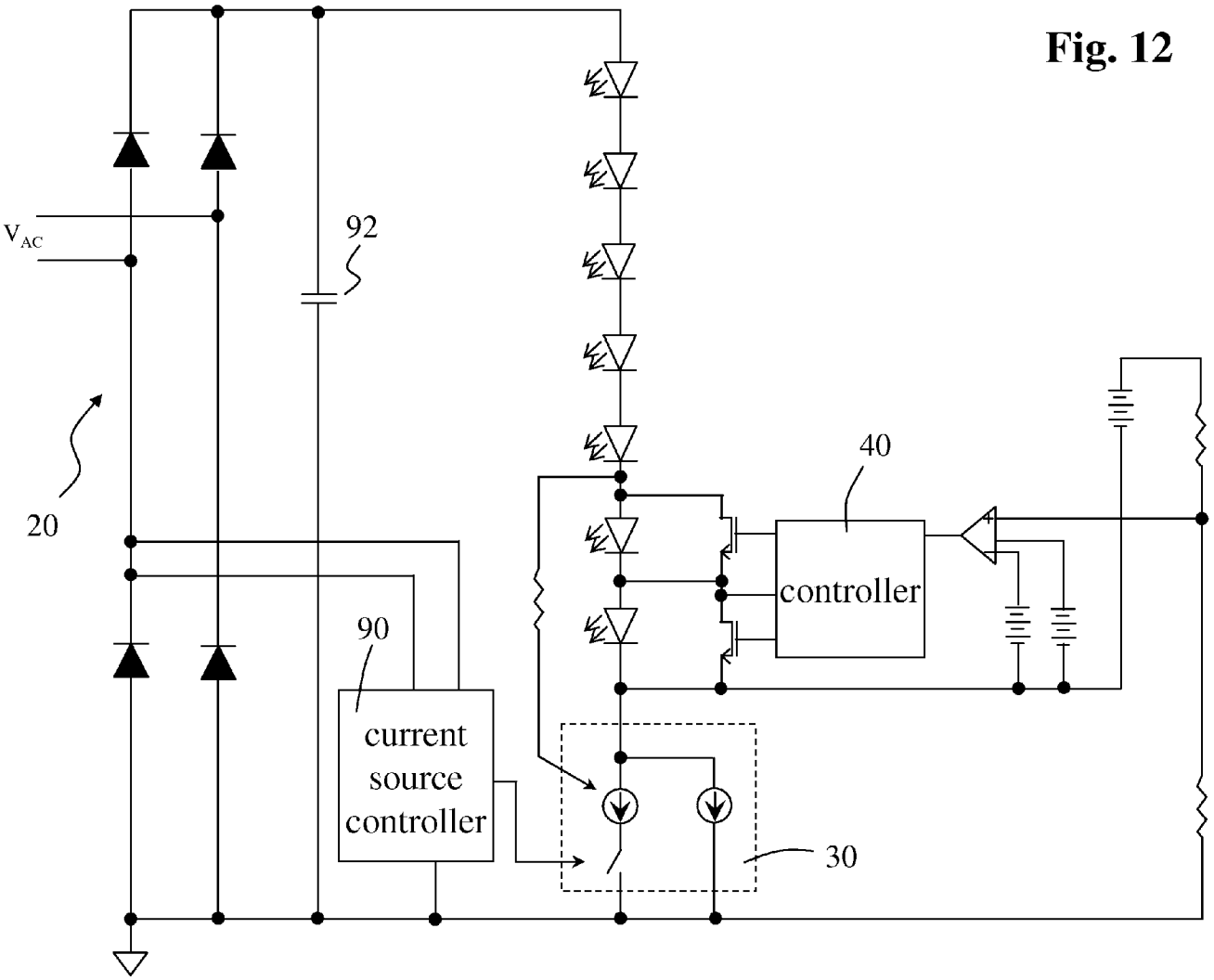
FIG. 12 is an exemplary circuit diagram of a device for driving an LED light in accordance with another embodiment of the present invention.

FIG. 12 illustrates another embodiment of a device for driving an LED light. In this embodiment, the device further comprises a current source controller 90 connected between the power module 10 and the current source 30. The current source controller 90 is synchronized to the rectified voltage at an operating frequency higher than 200 Hz (e.g. 240 Hz which is 4 times higher than an 60 Hz of AC input voltage), and modulates the current source to provide an adapted current to the LED string. The current source controller 90 turns the adapted current down to a small value during the "valley portion" of the rectified voltage waveform, which allows the filter capacitor 92 to be made smaller while still providing adequate energy storage to sustain the desired LED string current Since the current source controller 90 is synchronized to the rectified voltage, it means that the current source controller 90 knows at any given time exactly where that time point lies relative to the input waveform. The current source controller 90 is able to turn the current down during the valley portion of the rectified voltage, and also turn the current up as the waveform of the rectified voltage goes toward the peak. However, the controller can also turn the current down during other portions of the input voltage cycle as well as during the valley portion of the rectified voltage. This ability allows the effective flicker frequency to be moved higher than 200 Hz. The controller 40 fulfills its original propose, but also responds to the changes of the rectified voltage due to the small filter capacitor size. In this manner, the use of electrolytic capacitors can be avoided, the power factor of the device is also improved, and most important of all, the deleterious health effects due to low frequency flicker can be resolved.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A device for driving an LED light, comprising:

a power module being configured for providing a rectified voltage from an AC input voltage, wherein the power module comprises:

a diode rectifier converting the AC input voltage to a pulsating DC voltage; and a filter capacitor rectifying the pulsating DC voltage to the rectified voltage;

an LED string having multiple LED diodes connected in series that has a major segment and multiple minor segments;

a current source being connected to the power module, being connected to an first end or a second end of the LED string, and being configured for providing a constant current to the LED string driven by the rectified voltage; and at least one controller being connected to the current source and the minor segments of LED string, which selectively shorts out selected LED diodes of the minor segments, which make an overall forward voltage drop of the LED string that closely matches the rectified voltage, and the controller comprising:

a voltage sensing module being configured for sensing the rectified voltage;

at least one switch being connected to the minor segment of the LED string; and at least one switch controller turning the switch ON and OFF according to the sensed voltage from the voltage sensing module, which adds or subtracts the minor segment to the LED string, wherein as the rectified voltage increases more and more minor segments are added to the LED string which limits a withstand voltage of the current source.

2. The device as claimed in claim 1, further comprises a current limiting device that comprises:

a reference voltage;

a high-voltage transistor, a drain of the high-voltage transistor being connected to the negative side of a filter capacitor;

a current sensing resistor being configured for limiting the current to a desired value, and being connected between a source of the high-voltage transistor and the ground; and an amplifier having a first input being connected to the reference voltage;

a second input being connected to a gate of the high-voltage transistor and the current sensing resistor; and an output being connected to the gate of the high-voltage transistor.

3. The device as claimed in claim 1, wherein the at least one controller includes multiple controllers being connected in series and each controller connects to an successive controller and corresponding minor segments from the first end to the second end of the LED string.

4. The device as claimed in claim 1, further comprising a current source controller connected between the power module and the current source, wherein the current source controller is synchronized to the input voltage, and modulates the current source to provide an adapted current to the LED string.

5. The device as claimed in claim 1, wherein the numbers of the LED diodes in the minor segment is arranged in a binary format.

6. A device for driving an LED light, comprising:

a power module being configured for providing a rectified voltage from an AC input voltage;

an LED string having multiple LED diodes connected in series that forms a major segment and multiple minor segments; and a controller comprising:

at least one switch being connected to the corresponding LED string;

a current source;

a switch controller being configured to short the LED diodes of the minor segments through the switch based on a voltage across the current source.

7. The device as claimed in claim 6, wherein the controller further comprises a voltage sensing module, and the voltage sensing module comprises:

a resistor divider being connected to the current source and being configured to detect the voltage across the current source;

a voltage sensor being connected to the resistor divider for determining a voltage state based on the detected voltage from the resistor divider;

a code generator being connected to the voltage sensor and generating a level signal indicating the voltage state from the voltage sensor; and an oscillator being connected to the code generator and generating a clock signal indicating to the code generator to send out the level signal wherein the switch controller is connected to the code generator and is configured to short the minor segment through the switch based on the level signal.

8. The device as claimed in claim 7, wherein the switch controller is a hysteretic level shifter that has a low side and a high side, wherein the low side is connected to the code generator for receiving the level signal, and the high side generates a control signal selectively turning the switch ON and OFF according to the received level signal.

9. The device as claimed in claim 6, further comprising an offset unit connected to the minor segment of the LED string, wherein the offset unit is configured for modulating current through the current source to maintain a constant illumination of the LED string.

10. The device as claimed in claim 9, wherein the offset unit is an analog feedback circuit that detects an analog voltage representative of the number of shorted and opened LED diodes in the minor segment of the LED string.

11. The device as claimed in claim 9, wherein the offset unit produces a digital word representative of the number of shorted and opened LED diodes in the minor segment of the LED string.

12. A device for driving an LED light, comprising:

a power module being configured for providing a rectified voltage from an AC input voltage, wherein the power module comprises:

a diode rectifier converting the AC input voltage to a pulsating DC voltage; and a filter capacitor rectifying the pulsating DC voltage to the rectified voltage;

an LED string having multiple LED diodes connected in series that forms a major segment and multiple minor segments;

a current source being connected to the power module, being alternatively connected to an first end or a second end of the LED string, and being configured for providing a constant current to the LED string driven by the rectified voltage; and a controller being connected to the current source and the minor segments of LED string, and comprising:

a current decrease detector being connected to a second end of the LED string, and generating a triggering signal when a present current value is lower than the previous current value of the LED string or when the present current value is below a predetermined value; and a state machine being configured for selectively shorting out the LED diodes of the minor segment through at least one switch as triggered by the triggering signal of the current decrease detector.

13. The device as claimed in claim 12, wherein the controller further comprises:

a ripple voltage detector being connected between the power module and the state machine, and detecting a minimum value of a ripple voltage from the rectified voltage.

14. The device as claimed in claim 12, wherein the controller further comprises at least one error amplifier connected to the switches in a servo loop configuration.

* * * * *